US010233946B2

(12) United States Patent
Chaggar et al.

(10) Patent No.: US 10,233,946 B2
(45) Date of Patent: Mar. 19, 2019

(54) COMPRESSOR COVER ASSEMBLY METHOD AND FORMING TOOL

(71) Applicant: BorgWarner Inc., Auburn Hills, MI (US)

(72) Inventors: Sanjit Chaggar, Bradford (GB); Steve Birnie, Well Head (GB); James Mawer, Harrogate (GB); Andrew Richardson, Huddersfield (GB); Malcolm Carr, Mexborough (GB)

(73) Assignee: BorgWarner Inc., Auburn Hills, MI (US)

( * ) Notice: Subject to any disclaimer, the term of this patent is extended or adjusted under 35 U.S.C. 154(b) by 647 days.

(21) Appl. No.: 14/940,615

(22) Filed: Nov. 13, 2015

(65) Prior Publication Data

US 2016/0146220 A1 May 26, 2016

Related U.S. Application Data

(60) Provisional application No. 62/084,632, filed on Nov. 26, 2014.

(51) Int. Cl.

| | |
|---|---|
| ***B21D 39/04*** | (2006.01) |
| ***F04D 29/42*** | (2006.01) |
| ***F04D 29/62*** | (2006.01) |
| ***F04D 29/66*** | (2006.01) |

(52) U.S. Cl.

CPC ..... *F04D 29/624* (2013.01); *B21D 39/04* (2013.01); *F04D 29/4213* (2013.01); *F04D 29/663* (2013.01); *F05D 2220/40* (2013.01); *F05D 2230/64* (2013.01); *Y10T 29/4932* (2015.01); *Y10T 29/49236* (2015.01); *Y10T 29/49243* (2015.01); *Y10T 29/49327* (2015.01); *Y10T 29/49917* (2015.01); *Y10T 29/49918* (2015.01)

(58) Field of Classification Search

CPC .... F04D 29/663; F04D 29/664; F04D 29/624; F04D 29/4213; Y10T 29/49236; Y10T 29/49243; Y10T 29/4932; Y10T 29/49327; Y10T 29/49922; Y10T 29/4915; Y10T 29/49917; Y10T 29/49918; B21D 39/04; F05D 2220/40; F05D 2230/64

See application file for complete search history.

(56) References Cited

U.S. PATENT DOCUMENTS

| | | | | |
|---|---|---|---|---|
| 6,196,789 | B1 * | 3/2001 | McEwen | F04D 27/0215 415/119 |
| 2002/0071765 | A1 * | 6/2002 | Sahay | F02B 37/16 415/206 |
| 2013/0071241 | A1 * | 3/2013 | Walter | F01D 25/24 415/220 |

(Continued)

*Primary Examiner* — Jason L Vaughan
(74) *Attorney, Agent, or Firm* — BrooksGroup

(57) ABSTRACT

A method of assembling and retaining a noise attenuation device (30) within an air inlet (16) of a compressor cover (12) includes inserting the noise attenuation device (30) into the air inlet (16) and applying a rolling compressive force to the air inlet (16) using a forming tool (40). As a result, the air inlet terminal end (17) is deformed radially inward so as to form a radially-inwardly protruding lip (17b) about the air inlet terminal end (17). The radially-inwardly protruding lip (17*b*) is configured to retain the noise attenuation device (30) within the air inlet (16). The forming tool (40) used to form the radially-inwardly protruding lip (17*b*) is also described.

7 Claims, 4 Drawing Sheets

(56) References Cited

U.S. PATENT DOCUMENTS

| | | | | |
|---|---|---|---|---|
| 2015/0037141 | A1* | 2/2015 | Gerard | F04D 1/00 415/119 |
| 2015/0369642 | A1* | 12/2015 | Cox | F01D 17/02 73/112.05 |
| 2016/0131148 | A1* | 5/2016 | Murayama | F04D 25/024 415/58.4 |
| 2016/0258447 | A1* | 9/2016 | Day | F04D 29/685 |
| 2016/0305453 | A1* | 10/2016 | Burgess | F02B 37/12 |
| 2016/0363136 | A1* | 12/2016 | Slater | F02M 35/10354 |

* cited by examiner

COMPRESSOR COVER ASSEMBLY METHOD AND FORMING TOOL

CROSS-REFERENCE TO RELATED APPLICATIONS

This application claims priority to and all the benefits of U.S. Provisional Application No. 62/084,632, filed on Nov. 26, 2014 and entitled "Compressor Cover Assembly Method And Forming Tool", which is incorporated herein by reference.

FIELD OF THE INVENTION

The invention relates to a method of assembling a noise attenuation device in a turbocharger compressor cover, and a tool for facilitating the method.

BACKGROUND OF THE INVENTION

An exhaust gas turbocharger delivers compressed air to an engine intake, allowing more fuel to be combusted, thus boosting the horsepower of an engine without significantly increasing engine weight. Turbochargers typically include a turbine section connected to the exhaust manifold of the engine, a compressor section connected to the intake manifold of the engine, and a bearing housing disposed between and connecting the turbine section to the compressor section. A turbine wheel in the turbine section is rotatably driven by an inflow of exhaust gas supplied from the exhaust manifold. A shaft, rotatably supported in the bearing housing, connects the turbine wheel to a compressor wheel in the compressor section so that rotation of the turbine wheel causes rotation of the compressor wheel. As the compressor wheel rotates, the air mass flow rate, airflow density and air pressure delivered to the cylinders of the engine via the intake manifold of the engine increases.

SUMMARY

In some aspects, a method of assembling a compressor cover assembly using a forming tool is described. The compressor cover assembly includes a compressor cover and a noise attenuation device. The method includes inserting the noise attenuation device into an air inlet of the compressor cover; moving at least one of the compressor cover and the forming tool toward each other to an extent that the forming tool applies a deforming compressive force to the air inlet; and while the forming tool applies the deforming compressive force to the air inlet, rotating at least one of the forming tool and the compressor cover such that the forming tool deforms the air inlet along a path defined by the intersection of the forming tool and the air inlet. In the method, a deformation of the air inlet resulting from the steps of moving and rotating serves to retain the noise attenuation device in the air inlet.

The method may include one or more of the following steps and/or features: A step of moving at least one of the compressor cover and the forming tool toward each other comprising moving at least one of the compressor cover and the forming tool along an air inlet axis defined by the air inlet. A step of rotating at least one of the forming tool and the compressor cover comprising rotating at least one of the forming tool and the compressor cover about a longitudinal axis of the air inlet. Deformation of the air inlet resulting from the steps of moving and rotating comprises a radially inward deformation such that a circumferentially extending lip is formed about a terminal end of the air inlet. A forming tool including a cylindrical shank having a shank first end, a shank second end opposed to the shank first end, and a shank axis that extends through the shank first end and the shank second end. The forming tool includes an arm extending from the shank second end at an angle relative to the shank axis, the arm having a fixed end secured to the shank second end and a free end opposed to the fixed end. In addition, the forming tool includes a roller secured to the free end of the arm. A bearing is used to rotatably support the roller on the free end of the arm such that the rollers freely rotate about a longitudinal axis of the arm. A nut is used to retain the roller on the free end of the arm.

In some aspects, a forming tool is configured to deform an end of a cylindrical work piece. The forming tool includes a cylindrical shank, an arm and a roller. The shank has a shank first end, a shank second end opposed to the shank first end, and a shank axis that extends through the shank first end and the shank second end. The arm extends from the shank second end at an angle relative to the shank axis. The arm has a fixed end secured to the shank second end and a free end opposed to the fixed end. The roller is secured to the free end of the arm.

The forming tool may include one or more of the following features: A bearing used to rotatably support the roller on the free end of the arm such that the rollers freely rotate about a longitudinal axis of the arm. The bearing is a rolling element bearing. A nut used to retain the roller on the free end of the arm. The forming tool may also comprise four arms extending from the shank second end at an angle relative to the shank axis. While four arms are detailed herein, the forming tool may comprise at least one arm or any number of arms suitable for carrying out the invention. The forming tool further comprises a gusset that extends between the shank second end and the arm. A radial distance defined between the shank axis and a rolling surface of the roller, wherein the radial distance corresponds to a radius of the cylindrical work piece.

In some aspects, a compressor cover assembly includes a compressor cover that defines a hollow, cylindrical air inlet, and an annular noise attenuation device disposed in the air inlet. A terminal end of the air inlet includes a radially inwardly protruding lip, the lip extending about a circumference of the terminal end and serving to retain the noise attenuation device within the air inlet.

In some aspects, a method of assembling a compressor cover assembly is disclosed. The compressor cover assembly includes a compressor cover and a noise attenuation device disposed in an air inlet of the compressor cover. The method includes inserting the noise attenuation device into the air inlet and applying a rolling compressive force to the air inlet using a forming tool. As a result, the air inlet terminal end is deformed radially inward so as to form a circumferentially extending lip about the air inlet terminal end. The lip is configured to retain the noise attenuation device within the air inlet. This method of assembling a compressor cover assembly advantageously reliably secures the noise attenuation device within the air inlet without requiring fasteners, retaining devices or adhesives, and thus reduces manufacturing steps and part costs as compared to some conventional assembly methods.

Other objects and purposes of the invention, and variations thereof, will be apparent upon reading the following specification and inspecting the accompanying drawings.

DETAILED DESCRIPTION

Figure 1:
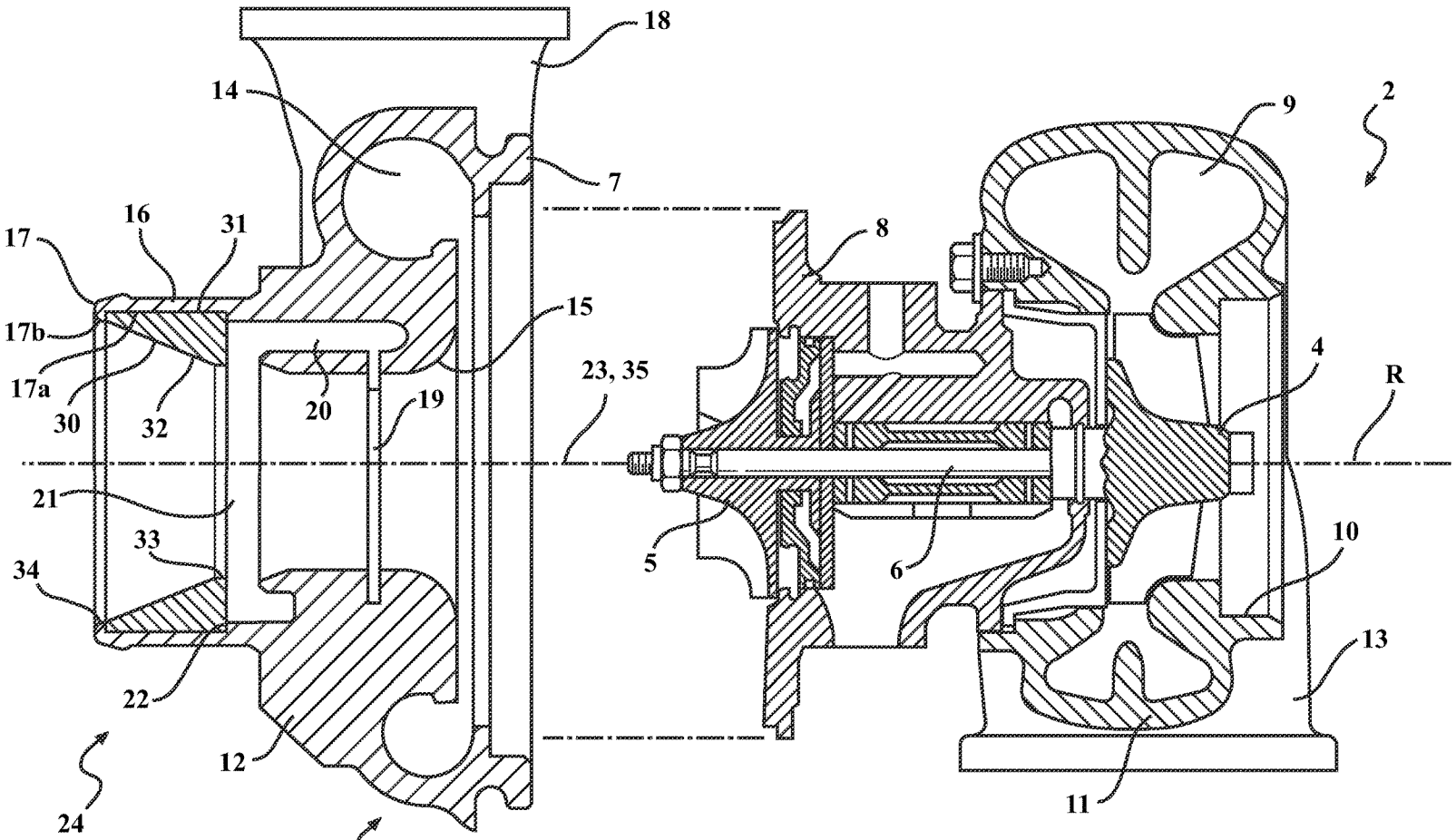
FIG. 1 is a partially exploded, cross-sectional view of an exhaust gas turbocharger including a noise attenuation device retained in the compressor air inlet via a lip formed in the air inlet terminal end.
Figure 2:
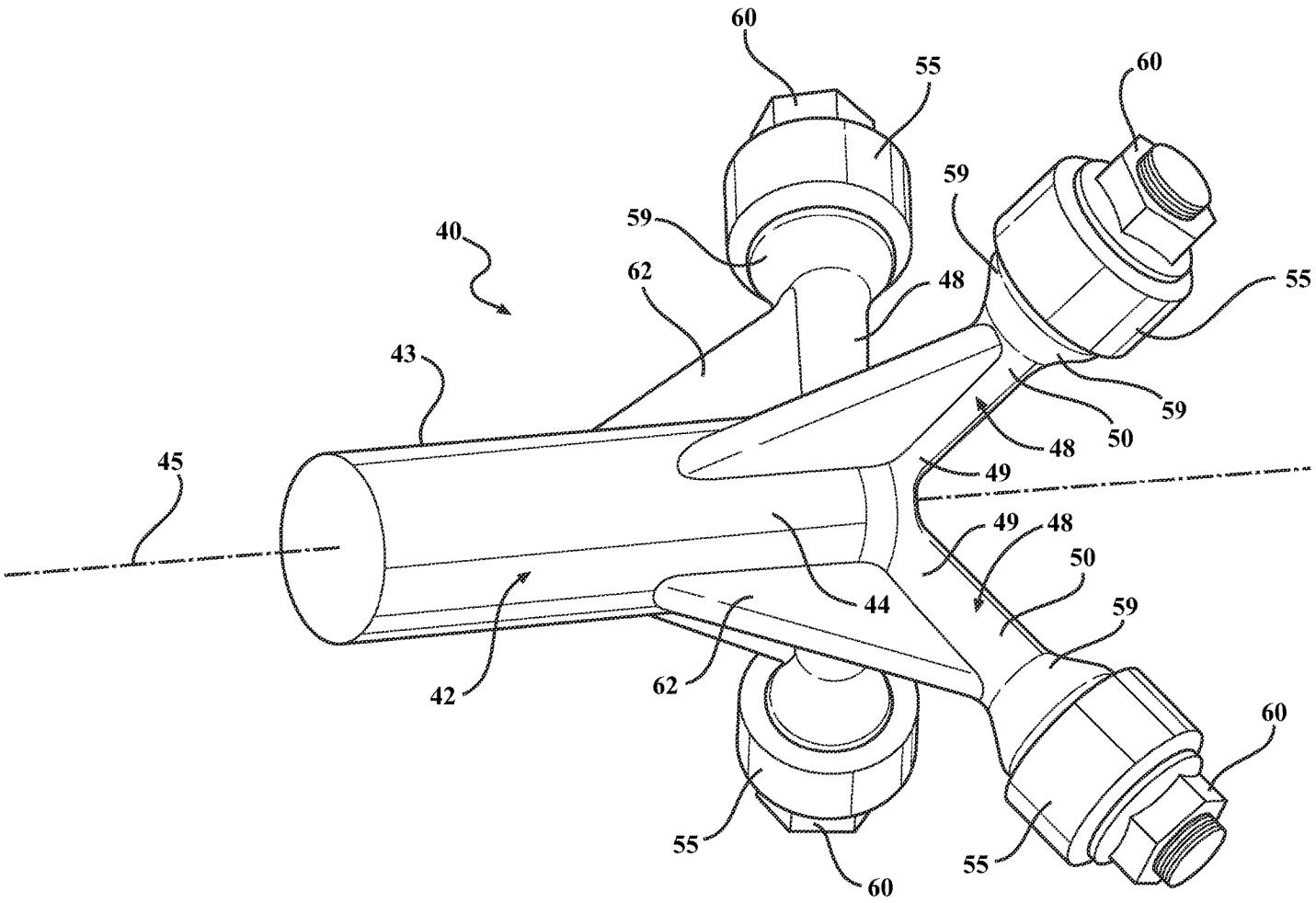
FIG. 2 is a perspective view of a forming tool used to deform the air inlet of a compressor cover.
Figure 3:
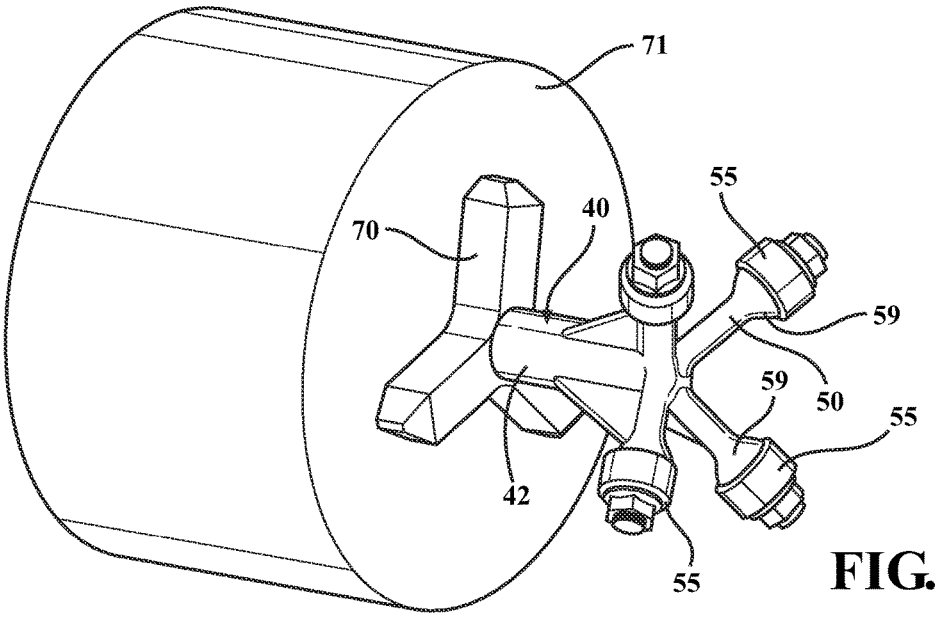
FIG. 3 is a perspective view of the forming tool of FIG. 2 mounted in a machine.

Referring to FIG. 1, an exhaust gas turbocharger 1 includes a turbine section 2, a compressor section 3, and a bearing housing 8 disposed between and connecting the compressor section 3 to the turbine section 2. The turbine section 2 includes a turbine housing 11 that defines an exhaust gas inlet 13, an exhaust gas outlet 10, and a turbine volute 9 disposed in the fluid path between the exhaust gas inlet 13 and exhaust gas outlet 10. A turbine wheel 4 is disposed in the turbine housing 11 between the turbine volute 9 and the exhaust gas outlet 10. A shaft 6 is connected to the turbine wheel 4, is rotatably supported within in the bearing housing 8, and extends into the compressor section 3. The compressor section 3 includes a compressor cover 12 that defines a cylindrical work piece such as an air inlet 16, an air outlet 18, and a compressor volute 14. A compressor wheel 5 is disposed in the compressor cover 12 between the air inlet 16 and the compressor volute 14. The compressor wheel 5 is connected to, and driven by, the shaft 6.

In use, the turbine wheel 4 in the turbine housing 11 is rotatably driven by an inflow of exhaust gas supplied from the exhaust manifold of an engine (not shown). Since the shaft 6 is rotatably supported in the bearing housing 8 and connects the turbine wheel 4 to the compressor wheel 5 in the compressor cover 12, the rotation of the turbine wheel 4 causes rotation of the compressor wheel 5. As the compressor wheel 5 rotates, it increases the air mass flow rate, airflow density and air pressure delivered to the cylinders (not shown) of the engine (not shown) via an outflow from the compressor air outlet 18, which is connected to the intake manifold (not shown) of the engine.

The air inlet 16 is a hollow, cylindrical member that extends coaxially with the rotational axis R of the shaft 6. An inner end 15 of the air inlet 16 is surrounded by the compressor volute 14, and the air inlet 16 protrudes from the compressor volute 14 so that an outer, terminal end 17 of the air inlet 16 is spaced apart from the compressor volute 14 along the rotational axis R. An inner surface 17*a* of the air inlet 16 includes a circumferentially-extending air recirculation slot 19 that surrounds the compressor wheel 5. An axially extending passage 20 formed in the compressor cover 12 connects the circumferentially-extending air recirculation slot 19 to a circumferentially-extending vent slot 21 positioned upstream of the circumferentially-extending air recirculation slot 19 relative to the direction of air flow into the compressor air inlet 16. The circumferentially-extending air recirculation slot 19 relieves air pressure at the compressor wheel 5 by permitting a portion of air to be redirected away from the compressor wheel 5 via the axially extending passage 20 and circumferentially-extending vent slot 21.

A noise attenuation device 30 is disposed in the air inlet 16 to reduce compressor noise. The noise attenuation device 30 is formed independently (e.g., as a separate entity) from the compressor air inlet 16, and subsequently assembled therewith. The compressor cover 12, together with the noise attenuation device 30, constitute a compressor cover assembly 24.

The noise attenuation device 30 is a generally hollow, cylindrical member having an outer surface 31 and a tapered inner surface 32. The inner surface 32 extends axially between a minimum diameter end 33 and a maximum diameter end 34 that is spaced apart from the minimum diameter end 33 along a device longitudinal axis 35. The device longitudinal axis 35 corresponds and is on the same plane as the rotational axis R of the shaft 6. In the illustrated embodiment, the tapered inner surface 32 extends linearly between the minimum diameter end 33 and the maximum diameter end 34. However, the inner surface 32 is not limited to a linear configuration, and instead may have a curved and/or non-linear profile. The tapered inner surface 32 serves to smoothly direct air into the compressor wheel 5, thus reducing noise and losses.

When the noise attenuation device 30 is assembled with the compressor air inlet 16, the noise attenuation device outer surface 31 faces the inner surface 17*a* of the air inlet 16 with minimal clearance. In addition, the noise attenuation device 30 is oriented so that the minimum diameter end 33 is downstream with respect to direction of air flow through the compressor air inlet 16 relative to the maximum diameter end 34. The noise attenuation device 30 is inserted into the air inlet 16 to an extent that the minimum diameter end 33 abuts a shoulder 22 formed immediately upstream of the circumferentially-extending vent slot 21, and maximum diameter end 34 resides within the air inlet 16 at a location slightly axially spaced from the air inlet terminal end 17.

The noise attenuation device 30 is retained within the air inlet 16 via a radially-inwardly protruding lip 17*b* (shown in FIGS. 5 and 6) formed in the air inlet terminal end 17 via a roll forming process. A forming tool 40 is used in the rolling process to form the lip radially-inwardly protruding lip 17*b* on the air inlet terminal end 17 after the noise attenuation device 30 has been installed within the air inlet 16, as discussed further below.

Referring to FIGS. 2-6, the forming tool 40 includes a shank 42 having a first end 43 configured to be received within a chuck 70 of a rotating machine 71 (shown in FIG. 3), arms 48 that protrude from an opposed, second end 44 of the shank 42, and a roller 55 mounted to a free end 50 of each arm 48. More particularly, the shank 42 has the form of a linear rod, and includes a shank axis 45 that extends through the shank first end 43 and the shank second end 44. The shank axis 45 corresponds to and is on the same plane as the rotational axis R of the shaft 6 and the longitudinal axis 35 of the noise attenuation device 30.

The arms 48 of the forming tool 40 are equidistantly spaced about the circumference of the shank 42. While four arms 48 are shown, the forming tool may include any number of arms 48 suitable for carrying out the invention. The arms 48 are substantially identical, so only one arm 48 will be described herein. The arm 48 has a fixed end 49 secured to the shank second end 44 and the free end 50 opposed to the fixed end 49. The arm 48 extends from the shank second end 44 at an angle θ (see FIG. 5) relative to the shank axis 45 so as to extend away from the shank 42. That is, the arm 48 does not overlie the shank 42.

The arm 48 includes a radially-outwardly protruding flange 59 (FIG. 3) disposed between the fixed end 49 and the free end 50. The flange 59 provides an axial stop for a bearing 64 (FIG. 5) that is supported on the arm 48 between the flange 59 and the free end 50. The bearing 64 is, for example, a rolling element bearing such as a ball bearing, but is not limited thereto. The roller 55 is supported for rotation relative to the arm 48 by the bearing 64. In particular, the bearing 64 is used to rotatably support the roller 55 on the arm free end 50 such that the roller 55 freely rotates about a longitudinal axis 54 of the arm 48. The bearing 64 and the roller 55 are retained on the free end of the arm 48 via a nut 60. To this end, the internal threads of the nut 60 engage corresponding threads (not shown) formed on the outer surface of the arm free end 50.

The roller 55 is hollow member having a cylindrical outer surface 56. The roller 55 is formed of a relatively hard material. For example, the roller 55 has a hardness that is greater than the hardness of the material used to form the compressor cover 12.

The forming tool 40 also includes a gusset 62 in the form of a triangular plate that extends between the shank second end 44 and each arm 48. The gusset 62 improves the stiffness of each arm 48 to prevent deflection of the arm 48 during the roll forming process.

The arms 48 are dimensioned and angled such that a radial distance between the shank axis 45 and the cylindrical outer (e.g., forming) surface 56 of the roller 55 corresponds to a radius Ra of the air inlet 16. For example, the angle θ is in a range of 20 degrees to 90 degrees. In the illustrated embodiment, the angle θ is 30 degrees.

Figure 4:
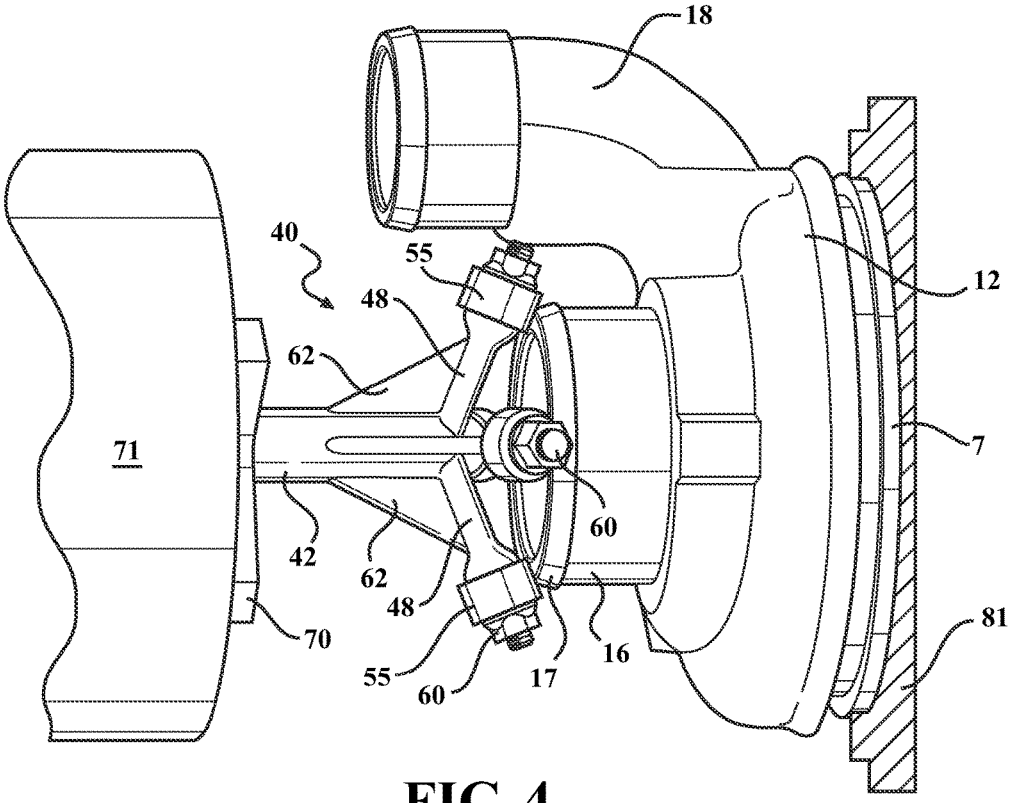
FIG. 4 is a perspective view of the forming tool of FIG. 2 in contact with the air inlet of the compressor cover.
Figure 5:
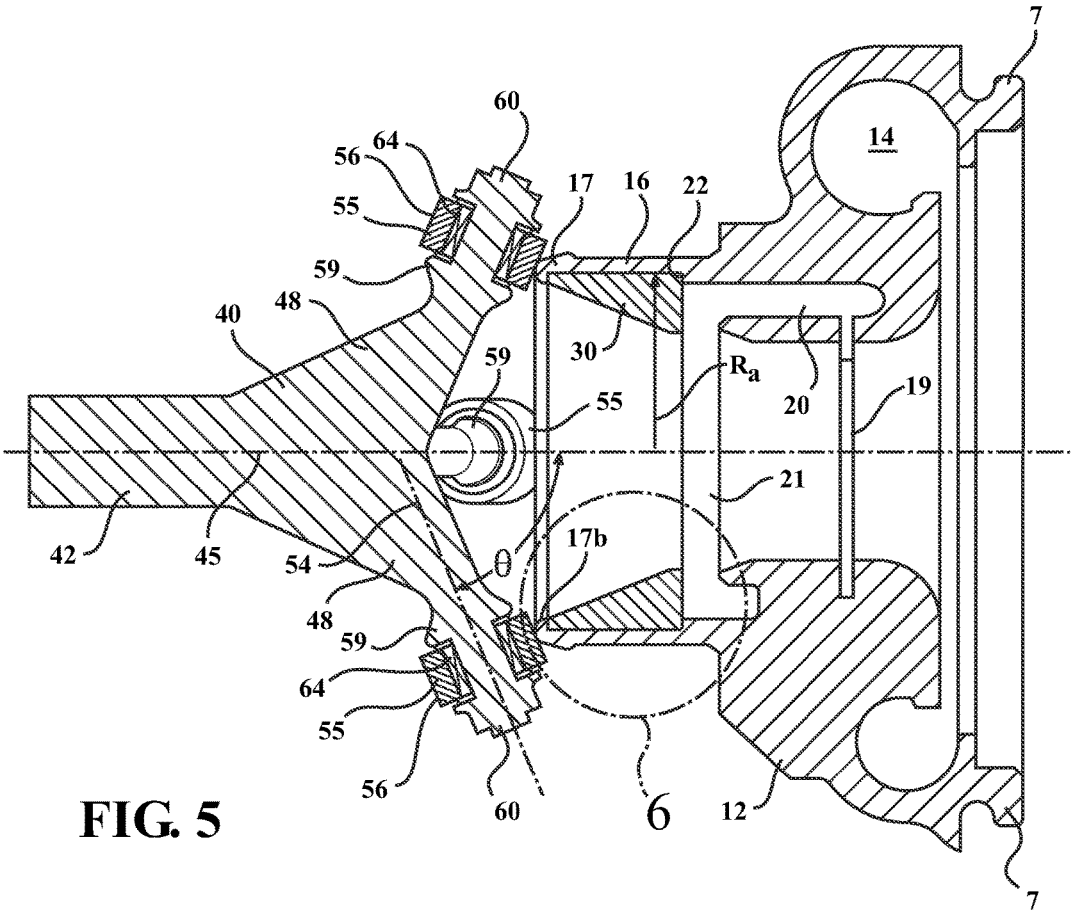
FIG. 5 is a cross-sectional view of the forming tool of FIG. 2 in contact with the air inlet of the compressor cover.
Figure 6:
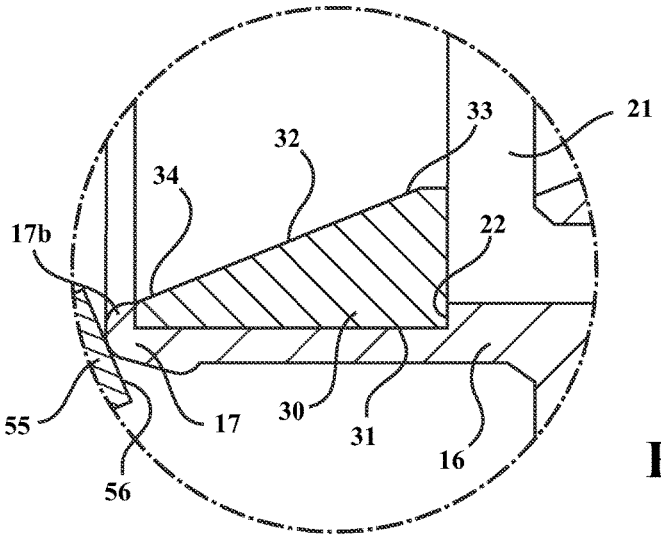
FIG. 6 is an enlarged view of a portion of FIG. 5.

Referring to FIGS. 4-6, a method of assembling the compressor cover assembly 24 that includes the compressor cover 12 and the noise attenuation device 30 will now be described.

Initially, the compressor cover 12 is mounted on an axially movable support device 81 (shown in FIG. 4) such as a press such that: a) the connecting flange 7 of the compressor cover 12 is fixed to the support device 81 via a clamp or other suitable fixture, and b) the air inlet axis 23 defined by the air inlet 16 extends in a direction normal to the support device 81. In addition, the forming tool 40 is mounted in the chuck 70 of the rotating machine 71 such that the shank axis 45 is coaxial with a rotational axis of the rotating machine 71. The support device 81 including the compressor cover 12 and the rotating machine 71 including the forming tool 40 are arranged so that the shank axis 45 of the forming tool 40 is positioned coaxial with the air inlet axis 23 of the compressor cover 12.

The noise attenuation device 30 is inserted into the air inlet 16 in the orientation described above, and such that the minimum diameter end 33 abuts the shoulder 22. The noise attenuation device 30 can be inserted into the air inlet 16 before or after the compressor cover 12 is secured to the support device 81.

When the noise attenuation device 30 has been inserted into the air inlet 16, and the support device 81 and rotating machine 71 are arranged so that the shank axis 45 is coaxial with the air inlet axis 23, the compressor cover 12 is moved (e.g., translated) along the air inlet axis 23 such that the air inlet terminal end 17 is moved with force into the rollers 55 of the forming tool 40. In particular, the compressor cover 12 and forming tool 40 are moved relative to one another to an extent that the rollers 55 of the forming tool 40 apply a deforming compressive force to the terminal end 17 of the air inlet 16.

While the air inlet 16 is being moved with the deforming compressive force into the forming tool rollers 55, the forming tool 40 is rotated about the shank axis 45 relative to the compressor cover 12 such that the forming tool 40 deforms the air inlet 16 along a path defined by the intersection of the rollers 55 and the air inlet 16. In particular, the path is circular and is defined by the movement of the rollers 55 along a circumference of the air inlet terminal end 17. Due to the applied axial compressive force, the rollers 55 deform the air inlet terminal end 17 such that the air inlet terminal end 17 is deformed radially inward so as to form the radially-inwardly protruding lip 17*b*. The deformation is sufficient that the radially-inwardly protruding lip 17*b* retains the noise attenuation device 30 within the air inlet 16. The method of assembling the compressor cover assembly 24 via the above described roll forming process advantageously reliably secures the noise attenuation device within the air inlet without requiring fasteners, fastening devices or adhesives, and thus reduces manufacturing steps and part costs as compared to some conventional assembly methods.

In the illustrated embodiment, the forming tool 40 is configured to be received within the chuck 70 of the rotating machine 71. As used herein the term "rotating machine" may refer to any one of a number of rotating machines configured to hold and rotate a tool or workpiece such as, but not limited to, a lathe or a rolling machine. The rotating machine may alternatively be a motor (not shown) in which a fixture is used to secure the forming tool shank 42 to an output shaft of the motor. In addition, the compressor cover 12 is described as being mounted within an axially movable support device 81 such as a press. However, the support device 81 is not limited to being a press, and may alternatively be some form of a tool bed, tailstock assembly, etc.

As described above, the rotating machine provides the relative rotating motion and the support device 81 provides the relative translation, but the method is not limited to this configuration. For example, in some embodiments, the support device 81 is a fixed device, and the rotating machine 71 is moved (axially and rotationally) relative to the support device 81 to apply the deforming compressive force. In other embodiments, the forming tool 40 is supported in a fixed support device, and the compressor cover 12 is supported in an axially moving and rotating machine.

In the described method, the support device 81 including the compressor cover 12 and the rotating machine 71 including the forming tool 40 are arranged so that the shank axis 45 of the forming tool 40 is positioned coaxial with the air inlet axis 23 of the compressor cover 12. It is contemplated, however, that for some alternative embodiments of the forming tool, it may not be necessary to have this aligned configuration.

In the illustrated embodiment, the roller 55 and bearing 64 are retained on the arm 48 via the nut 60. However, other devices can be used to retain the roller 55 and bearing 64 on the arm. For example, a lock collar can be substituted for the nut 60. In another example, an inner race of the bearing can be welded to the arm 48 and the nut 60 omitted.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A method of assembling a compressor cover assembly (24) using a forming tool (40) in which the compressor cover assembly (24) includes a compressor cover (12) and a noise attenuation device (30), the method comprising inserting the noise attenuation device (30) into an air inlet (16) of the compressor cover (12);

moving at least one of the compressor cover (12) and the forming tool (40) toward each other to an extent that the forming tool (40) applies a deforming compressive force to the air inlet (16); and while the forming tool (40) applies the deforming compressive force to the air inlet (16), rotating at least one of the forming tool (40) and the compressor cover (12) such that the forming tool (40) deforms the air inlet (16) along a path defined by the intersection of the forming tool (40) and the air inlet (16), wherein a deformation of the air inlet (16) resulting from the steps of moving and rotating serves to retain the noise attenuation device (30) in the air inlet (16).

2. The method of claim 1, wherein the step of moving at least one of the compressor cover (12) and the forming tool (40) toward each other comprises moving at least one of the compressor cover (12) and the forming tool (40) along an air inlet axis (23) defined by the air inlet (16).

3. The method of claim 1, wherein the step of rotating at least one of the forming tool (40) and the compressor cover (12) comprises rotating at least one of the forming tool (40) and the compressor cover (12) about the air inlet axis (23) of the air inlet (16).

4. The method of claim 1, wherein the deformation of the air inlet (16) resulting from the steps of moving and rotating comprises a radially inward deformation such that a radially-inwardly protruding lip (17*b*) is formed about a terminal end (17) of the air inlet (16).

5. The method of claim 1, wherein the forming tool (40) comprises a cylindrical shank (42) having a shank first end (43), a shank second end (44) opposed to the shank first end (43), and a shank axis (45) that extends through the shank first end (43) and the shank second end (44), an arm (48) extending from the shank second end (44) at an angle (θ) relative to the shank axis (45), the arm (48) having a fixed end (49) secured to the shank second end (44) and a free end (50) opposed to the fixed end (49), and a roller (55) secured to the free end (50) of the arm (48).

6. The method of claim 5, wherein a bearing (64) is used to rotatably support the roller (55) on the free end (50) of the arm (48) such that the rollers (55) freely rotate about a longitudinal axis (54) of the arm (48).

7. The method of claim 5, wherein a nut (60) is used to retain the roller (55) on the free end (50) of the arm (48).

* * * * *